United States Patent [19]

Jenkins

[11] 4,184,914

[45] Jan. 22, 1980

[54] FOAM COATING OF PAPER EMPLOYING A HYDROLYZED PROTEIN FOAMING AGENT

[76] Inventor: Byron Jenkins, 17 Hardwick Ave., Kidlington, Oxfordshire, England

[21] Appl. No.: 800,068

[22] Filed: May 24, 1977

[51] Int. Cl.[2] ..... D21F 11/00

[52] U.S. Cl. ..... 162/135; 162/137; 162/162; 162/164 R; 162/172; 162/174; 162/175; 162/181 R; 162/184; 427/358; 427/361; 427/363; 427/364; 427/391; 427/395; 427/411; 427/414

[58] Field of Search ..... 162/101, 174, 175, 184, 162/186, 135, 185, 136, 164 R, 181 R; 427/296, 350, 364, 395, 391, 414, 411, 361, 358, 363; 252/307; 106/122, 124

[56] References Cited

U.S. PATENT DOCUMENTS

| | | | |
|---|---|---|---|
| 1,740,280 | 12/1929 | Bryant | 162/101 |
| 1,777,945 | 10/1930 | Untiedt | 252/307 |
| 1,870,279 | 8/1932 | Bryant | 162/101 |
| 1,925,142 | 9/1933 | Hallett | 106/122 |
| 2,352,922 | 7/1944 | Thomas et al. | 162/174 |
| 2,370,058 | 2/1945 | Maguire | 252/307 |
| 2,409,628 | 10/1946 | Heritage | 162/174 |
| 2,947,647 | 8/1960 | Hart et al. | 162/101 |
| 2,971,458 | 2/1961 | Kumins et al. | 252/307 |
| 3,839,142 | 10/1974 | Clarke et al. | 162/185 |
| 4,018,647 | 4/1977 | Wietsma | 162/186 |
| 4,038,445 | 7/1977 | Robertson | 427/358 |

*Primary Examiner*—S. Leon Bashore
*Assistant Examiner*—Peter Chin
*Attorney, Agent, or Firm*—Finnegan, Henderson, Farabow & Garrett

[57] ABSTRACT

A method of reducing the number or amount of chemical additives normally incorporated into paper pulp furnish before transferring the latter to the continuous wire mesh of a papermaking machine in the manufacture of paper sheet involves the use of a hydrolyzed proteinaceous foam which does not appreciably affect the degree of sizing of the finished paper sheet. The use of such foam in paper manufacture can render unnecessary the chemical treatment of effluent from the papermaking machine which is normally required to avoid environmental pollution.

6 Claims, No Drawings

FOAM COATING OF PAPER EMPLOYING A HYDROLYZED PROTEIN FOAMING AGENT

This invention relates to the manufacture of paper and is concerned with the production on a papermaking machine of paper sheet from cellulose pulp, wherein an aqueous cellulose fibre pulp containing a mineral filler is fed to a continuous wire mesh at the so-called wet end of the papermaking machine so as to form a paper web which progresses through various treatment stages to the so-called dry end of the papermaking machine from which the paper sheet product finally emerges. The term "paper sheet" is used herein to mean both paper sheet of normal thickness and thick paper sheet normally termed board.

Chemical additives are generally incorporated into the aqueous pulp at the wet end of the machine and these may be divided into two groups, (a) those that are required to ensure that the product meets the required specification, i.e. product performance chemicals and (b) those required to allow the wet end of the machine to operate at an efficient level, i.e. process performance chemicals. Product performance chemicals include, for example, sizing agents, starches, wet-strength and dry-strength resins, and dyes whilst process performance chemicals include, for example, retention aids, defoamers and slimicides. If the additives incorporated into the aqueous pulp at the wet-end of the machine could be limited to the process performance chemicals, this would considerably reduce or even render unnecessary the chemical effluent treatment to which it is conventionally necessary to subject the waste materials obtained during the manufacturing process so as to avoid environmental pollution, because retention aids are employed in only very small amounts and the absence of product performance chemicals from the aqueous wet pulp at the wet end would considerably reduce the amounts of slimicides and defoamers required provided that the incoming process water used is of relatively high purity. The product performance chemicals required to enable the paper product to meet the required specification can then be added by alternative means. One such alternative is to apply the product performance chemical to the paper web in the form of a foam containing the chemical as described below.

Non-absorbent paper is required for many purposes and hence during the manufacture of the paper, sizing agents are incorporated therein. The sizing effect can be achieved either by "engine sizing", i.e. by mixing the sizing agent with the cellulose pulp before the latter is fed to the wet end of the papermaking machine, or by "surface sizing", i.e. applying the sizing agent to the paper web. The presence of the sizing agent in the paper reduces the absorbency of the paper and also gives it some resistance to water penetration. It also helps to increase the retention in the paper of fibres, fillers and dyestuffs. In effect the sizing agent causes the surface tension between water and the paper surface to increase, so reducing the "wetting up" effect of the water on the paper.

During the manufacture of paper sheet on the papermaking machine, it is general practice to subject the paper sheet to various surface treatment processes, which may include the application of a sizing agent as well as the coating of the paper sheet with various coating components. In these surface treatment processes, the sizing or coating compositions normally contain water as a carrier for the component with the consequence that further drying of the paper sheet is required. This is in addition to the normal drying which is necessary to remove the water contained in the cellulose stock applied to the wet end of the papermaking machine as it is converted into the paper web on the continuous moving wire mesh and at subsequent stages after sheet formation.

In order to reduce the amount of moisture which has to be removed during the papermaking process, it has been proposed to apply coating compositions in the form of a foam which is mechanically broken down after application to the paper sheet. By the use of a foam significant wetting of the paper sheet is obviated and hence the amount of drying necessary to remove water from the sheet is reduced. Similarly it has also been proposed to apply the cellulose stock to the wet end of the papermaking machine in the form of a foam. However in both these proposed procedures, the foam has been produced with the aid of a surface active agent (also termed a surfactant) such as sodium lauryl sulphate, generally in a low concentration such as 0.01 to 0.5 percent by weight. It has been found that as a result of the presence in the foam of the surface active agent, the degree of sizing of the paper is deleteriously affected and as a consequence, neither of these proposals has achieved commercial success in the production of a sized paper with normal concentrations of conventional sizing agents, such as rosin-alum combinations, alkyl ketone dimers, succinic anhydride and saponified rosin.

It has now unexpectedly been found in accordance with one aspect of the present invention that the advantages consequent upon the use of foam in the manufacture of sized paper can be obtained without the concomitant deleterious effect on the degree of sizing of the paper if there is used a foam derived from a particular type of non-surfactant foaming agent, namely a protein foaming agent capable of reducing the surface tension of water from a normal value of 72 dynes per centimeter to a value in the range from 45 to 65 dynes per centimeter. A foam produced from such a foaming agent will not substantially affect the sizing properties of a paper sheet, in contrast with a foam produced from a surface active agent which, because it acts as a detergent, can prevent size particles from directly adhering to the cellulose fibre and may even remove them physically from the fibre, so greatly reducing the degree of sizing of the paper sheet.

Suitable protein foaming agents for use in the present invention are those which are made from natural, regenerated or synthetic proteins by hydrolysis and subsequent neutralisation of a protein or proteinaceous extract naturally or artificially produced. The protein may be keratin or albumen present in, for example, hoof and horn meal, feathers and blood. The protein foaming agent is normally commercially available in the form of an aqueous solution containing the hydrolysed protein, which solution is agitated with a gas, normally air, optionally with the aid of mechanical means, to obtain a foam. Suitable protein foaming agents are commercially available as foam forming compositions useful for fighting fires, for example the commercially available compositions sold under the trade designations "Nicerol", "Pyrene Standard", "Pyrene Premix" and "CM foam compound" (see British Patent Specifications Nos. 1,349,509 and 1,368,463).

In accordance with the invention, a foam produced from a protein foaming agent can be used for various purposes in the manufacture of paper. For example the foam per se can be applied to one side of a paper sheet whilst a coating composition is simultaneously being applied to the other side of the sheet in order to obtain curl correction, i.e. to prevent the sheet from curling as a consequence of the application of the coating composition. The foam may also be used to act as a carrier for the application to paper web or paper sheet of a product performance material. Such materials may include, for example, natural or synthetic thermoplastic polymeric materials; thermosetting polymeric materials; polysaccharides and derivatives thereof, such as starch; animal and vegetable proteins, such as casein and gelatin; inorganic polymeric materials; natural and synthetic waxes; natural or synthetic pigments such as china clay, calcium carbonate and hydrated aluminum silicate; and sizing agents such as rosin and derivatives thereof.

Hence by the use of a foam in accordance with the invention, it is possible to apply the product performance chemicals to the paper web or sheet either at the wet end or dry end of the papermaking machine and thereby obtain the previously stated advantages attendant upon the omission of product performance chemicals from the aqueous pulp and upon the use of foam application of these chemicals to the paper web.

Thus in accordance with another aspect of the invention there is provided as a novel composition of matter a foamable composition comprising a protein foaming agent capable of reducing the surface tension of water from a value of 72 dynes per centimeter to a value in the range of from 45 to 65 dynes per centimeter and a product performance material for paper sheet. The composition will generally also contain some water, but additional water may be required prior to agitation of the composition with a gas to form a foam.

In accordance with a further aspect of the invention there is provided as a novel composition of matter a foam formed by agitation with a gas, generally air, of a foamable composition comprising water, a product performance material for paper sheet, and a protein foaming agent capable of reducing the surface tension of water from a value of 72 dynes per centimeter to a value in the range of from 45 to 65 dynes per centimeter.

In accordance with a still further aspect of the invention there is provided as a novel composition of matter a foam formed by agitation with a gas, generally air, of a foamable composition comprising water and a protein foaming agent capable of reducing the surface tension of water from a value of 72 dynes per centimeter to a value in the range of from 45 to 65 dynes per centimeter, and subsequent incorporation into the resulting foamed material of a product performance material for paper sheet.

Tests have been carried out to compare the effect on sized paper sheets of a foam produced from a protein foaming agent and a foam produced from a surfactant, namely sodium lauryl sulphate. As a result of these tests it was found that whereas the water repellency of the sheet was greatly decreased in the case of the surfactant foam, only a very slight change was obtained with a protein foam produced from "Nicerol" having a concentration ten times as great as that of the foam produced from the sodium lauryl sulphate. At the same time the normal properties of the paper, i.e. the basis weight, bulk, ash content, tear strength, tensile strength and burst strength, remained substantially unchanged with the protein foam, whereas in the case of surfactant foam, the burst strength of the paper was significantly affected.

The proteinaceous foams employed in the present invention can be prepared by diluting the commercially available aqueous solutions of hydrolysed protein foaming agents to a concentration of, for example from 0.5 to 5% by weight, preferably 1 to 2%, and then introducing a gas, preferably air, into the diluted solution so as to form the required foam, if necessary with the aid of mechanical means. When the foam is to contain a coating material, the latter may be incorporated in the dilution water for the foaming agent or may be incorporated into the initially prepared foam.

When the foam is applied per se to the paper web or is applied in conjuncation with a coating material, it is in most cases necessary to disintegrate the foam after it has been applied to the surface of the paper web and this may be effected by physical means, e.g. a rolling nip, a knife or an edge extending across the width of the web. For example a trailing edge, air knife, Meyer rod or reciprocating brush coater may be used to disintegrate the foam. However in some cases, for instance when a bubble coated foam is employed, it is not necessary to mechanically disintegrate the foam since the aqueous portion of the foam coating is removed by drying. The foam or foamed coating composition may be applied to a paper web by means of a manifold which may be adjusted to allow the appropriate amount of foam or coating composition to be applied to the paper web.

The following Examples illustrate how proteinaceous foams can be used in the manufacture of sized paper in accordance with the invention. In each of these Examples, the foam was prepared using as the foaming agent a commercially available aqueous solution of hydrolysed protein sold under the trade designation "Nicerol", which is capable of reducing the surface tension of water to a value of 60–65 dynes per centimeter.

EXAMPLE 1

Curl Correction with Plain Foam

This Example illustrates the use of the invention at the dry end of an alkaline papermaking system using whiting as mineral filler.

A paper pulp furnish was made up in a conventional manner from fully bleached chemical pulps and recycled broke (made from a similar furnish), so that the furnish comprised 34 weight % of hardwood, 36 weight % of softwood and 30% of the recycled broke. An internal alkaline sizing agent, namely the commercially available "Aquapel" marketed in the United Kingdom by Hercules Power Company Limited, was incorporated in the furnish, which then had a pH of 7.2. An aid for the retention of papermaking fibres/fillers and to maximise size retention was also being used, namely "Natron 88", which is a cationic retention aid marketed in the United Kingdom by Laing-National. To the furnish of fibres was added a whiting filler, namely Snowcal 8.SW, sold by The Cement Marketing Company Ltd., fed in at 25% w/w aqueous slurry to a point of addition in the thin stock line.

One-sided coated Gravure paper was then produced on a papermaking machine using a slightly alkaline system, the coating being applied at the size press by means of a Billblade coater manufactured by A. B. Inventing Company of Sweden. To one side of the paper sheet was added a coating mix containing latex for binder purposes and pigments for selected paper qualities and specifications to meet the requirements of the Gravure paper market. Normally to the other side of the paper sheet nothing is added at this stage or any other throughout the machine, which manufacturing paper at 3600 Kg. per hour at a speed of 260 meters per minute, with a coat weight pick-up of 16 g/m$^2$.

In this example foam was applied to the uncoated side of the paper sheet via the nip between the backing roll and paper at the Billblade coater position. The foam was made by addition of "Nicerol" concentrate to a tank of water to produce a resultant 1½% foamable solution which was then pumped by means of a Mono pump to the Billblade coater position at 10–12 liters/minute where it was agitated by the passage of air into the flow line, the resultant foam being produced through the distribution bar on the Billblade backing roll side.

The following table of results shows the difference between addition and non-addition of foam.

1. Without Foam
   Grade one-sided Gravure 70 g/m$^2$.
   Standard curl results should be:
   Machine: C-U
   Supercalender: Flat

| | Front | Middle | Back | |
|---|---|---|---|---|
| (a) | B-U | B-U | B-U | Machine |
| (b) | Flat | Flat | Flat | |
| (a) | F-C | F-C | F-C | Supercalender |
| (b) | F-C | F-C | F-C | |

2. With Foam
   Grade one-sided Gravure 70 g/m$^2$.
   Standard curl results as above.

| | Front | Middle | Back | |
|---|---|---|---|---|
| (a) | C-U | A-U | C-U | Machine |
| (b) | C-U | B-U | B-U | |
| (a) | D-U | D-U | D-U | Supercalender |
| (b) | B-C | A-C | B-C | |

In the foregoing results, "U" refers to the uncoated side of the paper sheet and "C" refers to the coated side. The letters "A" to "F" relate to progressively increasing degrees of curvature of the paper sheet, "A" referring to a substantially flat sheet and "F" referring to a completely curled sheet, i.e. a tube-shaped sheet.

It can be concluded from the above results that the foam aids in correcting inherent curl resulting from the coating of one side of the paper sheet.

It must also be noted that the Cobb value remained on 20 in both cases, i.e. the degree of sizing of the paper sheet was unaffected.

EXAMPLE 2

Starch Addition with Foam at Backing Roll Side of Billblade Coater

One sided coated Gravure paper was produced in the manner described in Example 1, except that in this Example, foam/starch was applied to the uncoated side of the paper sheet via the nip between the backing roll and paper at the Billblade coater position. A foamable mixture was made up by addition of "Nicerol" concentrate to a tank of 6% starch (Viscosol 410 manufactured in the United Kingdom by Starch Products Company) with three parts dry on dry weight of Resin 5084 (manufactured in the United Kingdom by B. I. P. Company) to obtain a 1½ volume/volume addition of foaming agent. The foamble mixture was then pumped by means of a Mono pump to the Billblade coater position at 10–12 liters per minute where it was agitated by the passage of air into the flow line, the resultant foam/starch being produced through the distribution bar on the Billblade backing roll side.

The following table of results shows the difference between addition and non-addition of foam/starch.

Results

Reel 1 with foam/starch application

| Substance | Sub-Variation | % Ash | Moisture M/C | Moisture S/C | Gloss | Smoothness F | Smoothness M | Smoothness B | Pick | I.G.T. |
|---|---|---|---|---|---|---|---|---|---|---|
| 70 | 6.5 | 23 | 5.0 | 4.8 | 63 | 12 | 12 | 12 | 12 | 470 |

| Cobb | Bulk | Burst | Opacity | K & N | Brightness | Micro Contour |
|---|---|---|---|---|---|---|
| 22 | 48 | 160<br>160 | 89<br>86 | 15 | 82 | 9 |

Reel 2 without foam/starch application

| Substance | Sub-Variation | % Ash | Moisture M/C | Moisture S/C | Gloss | Smoothness F | Smoothness M | Smoothness B | Pick | I.G.T. |
|---|---|---|---|---|---|---|---|---|---|---|
| 72 | 5.5 | 24 | 5.6 | 3.7 | 63 | 8 | 9 | 12 | 10 | 470 |

| Cobb | Bulk | Burst | Opacity | K & N | Brightness | Micro Contour |
|---|---|---|---|---|---|---|
| 24 | 47 | 135<br>130 | 88<br>86 | 20 | 82 | 6 |

N.B. The difference in the results is shown by Dennison wax pick on the treated side and a change in burst characteristic. The Dennison wax pick test is a standard in the paper industry for determination of surface strength; method of use is given in Tappi T459 SU65 or Canadian Pulp and Paper Technical Section Standard D11.

It will be noted that only a slight reduction in the degree of sizing of the paper sheet occurred.

EXAMPLE 3

Addition to Wet Strength Resin with Foam at Backing Roll Side of Billblade

One sided coated Gravure paper was produced in the manner described in Example 1, except that in this Example foam/Kymene 557 (a wet-strength resin manufactured by Hercules Powder Company Limited) was applied to the sheet in the same position as in Examples 1 and 2.

The foam was made up by addition of "Nicerol" concentrate in a 1½% volume/volume ratio with a 5% solution of Kymene 557 in the usual tank and pumped via the Mono pump at 10–12 liters per minute to the same position as in Examples 1 and 2, with air injection.

Results

Pick up of Kymene 557 dry in the sheet was approximately 0.5%. The paper properties changed only with regard to wet strength characteristics, i.e. the paper which normally exhibited a wet/dry burst or tensile of the order of 5% was now showing 15%. Cobb remained at 22 before and after the addition of the Kymene/foam.

EXAMPLE 4

Effect of Foam Carrying High Concentration of Starch at Wet End of Machine

The procedure of Example 1 was followed except that the sheet being produced was 70 g/m$^2$, but was uncoated, i.e. the Billblade head was taken off and therefore no surface treatment to the paper was being used except that deemed possible by the foam application to be used.

In the papermaking machine, the paper off the making fabric passes through presses, in this case both being conventional suction press arrangements. The trial in this instance was run on the second press, and took the following lines:

"Nicerol" foam concentrate was added at 1½% volume/volume ratio to a 10% solution of starch plus resin as given in Example 2. This was then pumped through a Mono pump at 10 liters/minute with air injection to a distribution bar arrangement set up on the top side of the second press ingoing nip, i.e. so that the issuing foam landed on the top side of the paper sheet.

Results

These are given in two stages, i.e. (a) with no foam/starch on paper, thus the issuing paper being 70 g/m$^2$ base with no surface application at all and (b) with foam/starch but no other surface additions.

| | | |
|---|---|---|
| (a) | Sheet weight 70 g/m$^2$<br>Dennison Wax Pick | Burst 90 Kpa<br>Topside 5<br>Wireside 5 |
| (b) | Sheet weight 74 g/m$^2$<br>Dennison Wax Pick | Burst 170 Kpa<br>Topside 12<br>Wireside 16 |

No change was observed in other properties other than strength, again the Cobb (sizing test) remained unchanged. The above ran for 30 minutes on machine without a break in sheet.

EXAMPLE 5

Production of Latex-Pigment Coated Sheet with Foam as Coating Carrier

This Example describes production on a laboratory scale. The trial took place with some 75 g/m$^2$ base paper and the coatings were applied by means of a Skinner's Laboratory coater unit, manufactured by Skinner's Company, Southhampton.

The foam coating mix was made as follows: 1½% volume/volume "Nicerol" foam concentrate was added to a mixing vessel together with a coating mix which consisted of latex (binder), calcium carbonate (whiting) as pigment and C.M.C. (carboxymethylcellulose) as foam stabilizer. This mixture was then agitated by beating, the total solids of mix being 70%. The foam mix was then metered on the sheet and applied by means of blade arrangement in the laboratory coater. A comparison run was also made using a surfactant of the sodium lauryl sulphate type, to produce the following results:

(a) With "Nicerol" foam

| Substance (Final) | Ash % | Gloss | Finish |
|---|---|---|---|
| 98 g/m$^2$ | 30 | 15 | 40 |
| **Porosity** | **Bulk × 8** | **Opacity** | **Burst** |
| 5 | 62 | 90 | 200 |
| **I.G.T.** | **Cobb** | **Pick** | |
| 600 | 23 | 11 | |

The sheets were supercalendered to produce the above results of a matt coated sheet.

(b) With surfactant foam

The results obtained were the same as those shown in (a) but the sizing of the paper was completely removed.

EXAMPLE 6

Addition of foam/starch to board

A foamable mixture similar to that described in Example 2 was made up, except that a 10% starch concentration was used. The starch/foam produced was applied to both sides of a board sheet as it passed between two rolls of a size press used on a board-making machine capable of producing board by a dry forming technique.

It was found that the starch/resin mixture deposited by means of the foam was maintained on the surfaces of the board to produce board having normal stiffness but giving increased fold and smoothness figures.

What is claimed is:

1. A method for reducing the curl of a sized paper sheet having a coating on one side and without substantially lowering the degree of sizing thereof, which comprises applying to the other side of the paper web during the manufacture of the coated and sized paper sheet on a paper making machine, a proteinaceous foam forming composition containing a hydrolyzed protein foaming agent capable of reducing the surface tension of water from a normal value of 72 dynes per centimeter to a minimum value in the range of from 45 to 65 dynes per centimeter.

2. The method of claim 1, wherein the foam also contains sizing agent for the paper sheet.

3. An improved process for applying a product performance material selected from the group consisting of sizing agents, starches, polysaccharides, proteins, waxes, wet strength resins, dry strength resins, dyes and pigments to a sized paper sheet without substantially lowering the degree of sizing thereof, which comprises applying to the surface of the paper web during the manufacture of the sized paper sheet on a paper making machine, a foam containing the product performance material and a hydrolyzed protein foaming agent as a carrier for the material capable of reducing the surface tension of water from a normal value of 72 dynes per centimeter to a minimum value in the range of from 45 to 65 dynes per centimeter.

4. The method of claim 3 wherein the product performance material is selected from the group consisting of polysaccharides, proteins, waxes and pigments.

5. The method of claim 3, wherein the material is starch.

6. The method of claim 3, wherein the foam also contains sizing agent for the paper sheet.

* * * * *